US011568887B1

(12) United States Patent
Sarzen et al.

(10) Patent No.: US 11,568,887 B1
(45) Date of Patent: Jan. 31, 2023

(54) DEVICES, SYSTEMS, AND METHODS FOR REAL TIME SURVEILLANCE OF AUDIO STREAMS AND USES THEREFORE

(71) Applicant: AgLogica Holding, Inc., Peachtree Corners, GA (US)

(72) Inventors: Marcel Joseph Sarzen, Sandy Springs, GA (US); Christopher George Rosati, Duluth, GA (US)

(73) Assignee: AGLOGICA HOLDING, INC., Peachtree Corners, GA (US)

( * ) Notice: Subject to any disclaimer, the term of this patent is extended or adjusted under 35 U.S.C. 154(b) by 0 days.

(21) Appl. No.: 17/234,186

(22) Filed: Apr. 19, 2021

Related U.S. Application Data

(60) Provisional application No. 63/011,509, filed on Apr. 17, 2020.

(51) Int. Cl.
*G10L 25/00* (2013.01)
*H04R 29/00* (2006.01)
(Continued)

(52) U.S. Cl.
CPC ..... *G10L 25/66* (2013.01); *G08B 21/02* (2013.01); *G10L 25/57* (2013.01); *H04R 1/08* (2013.01);
(Continued)

(58) Field of Classification Search
CPC . H04R 1/08; H04R 3/00; H04R 3/005; H04R 29/00; H04R 29/004; H04R 29/007; H04R 29/008; H04R 2420/07; G10L 25/00; G10L 25/51; G10L 25/54; G10L 25/57; G10L 25/60; G10L 25/6678; G10L 25/87; G08B 21/00; G08B 21/02; G08B 21/0297
See application file for complete search history.

(56) References Cited

U.S. PATENT DOCUMENTS 9,087,447 B2 * 7/2015 Gruber ..... G08B 21/14
9,412,387 B2 * 8/2016 Davis ..... H04W 4/024
(Continued)

FOREIGN PATENT DOCUMENTS

CA 2657149 A1 * 1/2008 ..... G06F 10/00
CN 102259629 A * 11/2011 ..... G08B 21/02
EP 3193316 A1 * 7/2017 ..... G08B 1/08

*Primary Examiner* — Thang V Tran
(74) *Attorney, Agent, or Firm* — Thomas | Horstemeyer, LLP

(57) ABSTRACT

Various examples are provided for surveillance of an audio stream. In one example, a method includes identifying presence or absence of a sound type of interest at a location during a time period; selecting the sound type from a library of sound type information to provide a collection of sound type information; incorporating the collection on a device proximate to the location; acquiring an audio stream from the location by the device to provide a locational audio stream; analyzing the locational audio stream to determine whether a sound type in the collection is present in the audio stream; and generating a notification to a user or computer if a sound type in the collection is present. The device can acquire and process the audio stream. In another example, a bulk sound type information library can be generated by identifying sound types of interest including them based upon a confidence level.

18 Claims, 3 Drawing Sheets

(51) Int. Cl.

| | |
|---|---|
| ***G10L 25/66*** | (2013.01) |
| ***H04R 1/08*** | (2006.01) |
| ***G08B 21/02*** | (2006.01) |
| ***G10L 25/57*** | (2013.01) |

(52) U.S. Cl.
CPC ..... *H04R 29/00* (2013.01); *H04R 29/004* (2013.01); *H04R 2420/07* (2013.01)

(56) References Cited

U.S. PATENT DOCUMENTS

| | | | | |
|---|---|---|---|---|
| 10,409,860 | B2 * | 9/2019 | Goldstein | G06F 16/635 |
| 10,914,811 | B1 * | 2/2021 | Wild | H04M 11/025 |
| 2020/0145956 | A1 * | 5/2020 | Goldstein | H04W 64/00 |
| 2021/0298272 | A1 * | 9/2021 | Sarzen | A61B 5/742 |

* cited by examiner

DEVICES, SYSTEMS, AND METHODS FOR REAL TIME SURVEILLANCE OF AUDIO STREAMS AND USES THEREFORE

CROSS-REFERENCE TO RELATED APPLICATIONS

This application claims priority to U.S. Provisional Patent Application No. 63/011,509, filed Apr. 17, 2020, the disclosure of which is incorporated herein in its entirety.

BACKGROUND OF THE DISCLOSURE

In recent years, automated surveillance systems have become useful in both private and public environments. Surveillance systems can be used for a variety of purposes, including monitoring the behavior and activities, or other observable information, of humans, animals, and machines. People and spaces are typically monitored for purposes of influencing behavior or for providing protection, security, or peace of mind. Surveillance systems can allow organizations, including businesses, governments, private companies, educational institutions, healthcare facilities, congregate residences, sporting arenas, music venues, theaters, and the like to recognize and monitor threats, to prevent and investigate criminal and other undesirable activities, and as well as to respond to situations as appropriate. In short, surveillance systems assist many types of businesses and organizations to manage risks associated with various behaviors and activities that may occur at a location.

Today, automated surveillance systems are typically based on video surveillance. Video is generally considered as a suitable substitute for the visual perception of a person at a location where the computer is configured with remote visual perception generated by computer vision processes. However, the effectiveness of this type of surveillance system is highly dependent on the environmental conditions present at the location. The ability to detect relevant information from remotely obtained video imagery may then be highly influenced by the ability of the computer to "see the information of interest in a scene via an appropriately configured algorithm. Non-optimal lighting situations remain challenging for computer vision today. Thus, video-based type of surveillance systems available that rely on automated detection can have a high likelihood of failing at night, in foggy environments or in other low visibility conditions, such as in a low or no light interior environments.

Privacy concerns are also an issue with automated video surveillance. Some people are becoming wary of unregulated and ubiquitous video imaging, especially since it has become known that many video surveillance is being augmented with facial recognition technology, which can pose privacy risks. Thermal cameras can operate as a less invasive alternative, but its utility can be limited. To this end, thermal cameras may be highly dependent on the ambient temperature at a location, and the ability to detect separation between background and foreground objects can present a challenge for existing thermal camera detection methods. Moreover, the detail needed to discern activities or behaviors that may be of interest at a location, such as a health-related condition like a person's coughing, sneezing or signs of distress (e.g., crying, shouting, etc.), may be virtually impossible to identify from thermal imaging, Sound-based activities or behaviors, such as gunshots, breaking glass, etc. may not be observable at all from thermal camera surveillance methods.

Methods to analyze audio streams for use in surveillance have been proposed recently. However, such methods typically use audio to supplement video surveillance. These existing methods generally suffer from a lack of specificity as to the sounds that may be relevant to a particular location, which may vary by the type of business, behavior, and/or activities that may be associated therewith. Put simply, existing proposals to use audio streams for automated surveillance systems have not reached the point where the acquisition, analysis, and, if needed, notification to mitigate or prevent business risk to a location can be conducted automatically.

A further limitation to automated audio surveillance is the latency indicative of systems that rely on uploading of data streams to a cloud server platform for analysis. This latency can also be a problem with video and thermal surveillance methods. For surveillance to be effective, detection and notification of conditions that might cause risk or problems at the location in context must be provided in near real time. In short, remote surveillance systems—whether they are based on audio data, video data, thermal data, or a combination thereof—must be able to provide detection ability and response accurate enough to substitute for response by a human who is present at the location when an issue arises.

There is a need for improvements in the ability to provide automated surveillance in a particular location or for a specific business that is relevant in context, especially when the surveillance of activities or behaviors are appropriately discerned from an audio stream derived from that location. Moreover, there is a need for such automated surveillance to be provided via onsite analysis of an audio stream using an on-premises device to allow substantially immediate analysis and notifications relevant to such analysis. The present disclosure provides these, and other, improvements.

SUMMARY OF THE DISCLOSURE

Aspects of the present disclosure are related to surveillance of an audio stream, which can be carried out in real time. In one aspect, among others, a method of conducting real-time surveillance of a location of interest from an audio stream comprises identifying, by either or both of a user or a computer, a presence or absence of one or more sound types of interest at a location during a time period; selecting, by either or both of the user or the computer, the one or more sound types of interest from a library of sound type information, thereby providing a collection of sound type information; incorporating, by the computer, the collection of sound type information on one or more devices proximate to the location; acquiring an audio stream from the location by the one or more of the devices, thereby providing a locational audio stream; analyzing, by the one or more devices, the locational audio stream to determine whether one or more of the sound types in the collection of sound type information is present in the audio stream, wherein at least some of the locational audio stream analysis is conducted by processing the locational audio stream via edge computing capability operational on the one or more devices without first uploading the locational audio stream to a cloud computing server; and generating a notification to the user or the computer if one of the one or more sound types in the collection of sound type information is present in the locational audio stream, wherein the notification is generated to the user or the computer directly from one of the devices. The one or more devices can be individually or collectively configured with each of: sound acquisition capability; sound processing capability; communications capability; and storage capability for the sound library collection.

On one or more aspects, the locational audio stream can be generated from one or more sound types in the collection of sound type information comprising each of a human, an animal, an object, or a machine. At least one of the one or more sound types in the collection of sound type information can be selected from a library of sound type information associated with categories of business risk assigned to the location of interest. At least one of the one or more sound types of interest comprises one or more of: a sound associated with a human health condition; a sound associated with a human, animal, object, or machine safety condition; or a business compliance condition. In some aspects, audio stream acquisition capability can be provided on each of the one or more devices by one or more wireless or wired microphones in communications engagement with the one or more devices. The one or more devices can be in operational engagement with one or more of: a video capture device; or one or more environmental sensors.

In various aspects, additional sound type information can be derived from each of a plurality of locational audio streams generated from a plurality of locations during one or more time periods of interest, and the additional sound type information can be incorporated into the library of sound type information, thereby providing updated sound library information. The additional sound type information can be generated by human review of the plurality of locational audio streams to generate human validated sound type information. The method can further comprise selecting, by the user or the computer, at least some of the additional sound type information from the updated sound library information and incorporating the selected additional sound type information into the collection of sound type information operational on the one or more devices for processing. A plurality of notifications associated with a presence or absence of a sound type of interest in the locational audio stream can be generated, and the plurality of notifications can be presented to a user in a dashboard format. When the presence or absence of one or more of the one or more sound types of interest is identified in the audio stream, a real time notification can be provided to the user via communication to a mobile device.

In another aspect, a bulk sound type information library is generated by: identifying, by either or both of a user or a computer, one or more sound types of interest for determining presence or absence of the one or more sound types of interest at a location during a time period; acquiring, by one or more sound acquisition devices, one or more audio streams each, independently, incorporating the one or more sound types of interest; processing, by the computer, each of the one or more sound types of interest in the one or more audio streams, thereby generating sound type information and, optionally, notifications to the user or the computer; reviewing, by a human, at least some of the sound type information and, in response to the human review, generate a confidence level for the sound type information generated from the computer processing; selecting, by the user or the computer, a selected confidence level for inclusion of sound type information in a sound type library; and incorporating, by the computer, the sound type information having a confidence level that is greater than the selected confidence level into the sound type library. In one or more aspects, the bulk sound type information library can be categorized by sound type classes, wherein the sound type classes can be associated with one or more of: a sound associated with a human health condition; a sound associated with a human, animal, object, or machine safety condition; and a business compliance condition.

In various aspects, the bulk sound type information library can be updated with sound type information generated from analysis of a second audio stream generated at a second location of interest, wherein information derived from the second audio stream analysis can be incorporated into the bulk sound type information library, thereby providing a bulk sound type library information updated with locational sound type information. The information derived from the second audio stream can be at least partially validated by a human prior to incorporation of the locational sound type information into the bulk sound type information library. The bulk sound type information library can be configured with information derived from one or both of: one or more video streams generated from an image device proximate to the one or more locations; or one or more environmental sensors proximate one or more of the locations. A sound type selection from the sound type library can be derived from the bulk sound type information library for operation on a device having audio stream processing capability, wherein the device is configured to acquire an audio stream proximate to the location, and wherein at least some of the audio stream processing can be conducted while the device is at the location.

Additional advantages of the disclosure will be set forth in part in the description that follows, and in part will be apparent from the description, or may be learned by practice of the disclosure. The advantages of the disclosure will be realized and attained by means of the elements and combination particularly pointed out in the appended claims. It is to be understood that both the foregoing general description and the following detailed description are exemplary and explanatory only and are not restrictive of the disclosure, as claimed.

DETAILED DESCRIPTION OF THE DISCLOSURE

Figure 1:
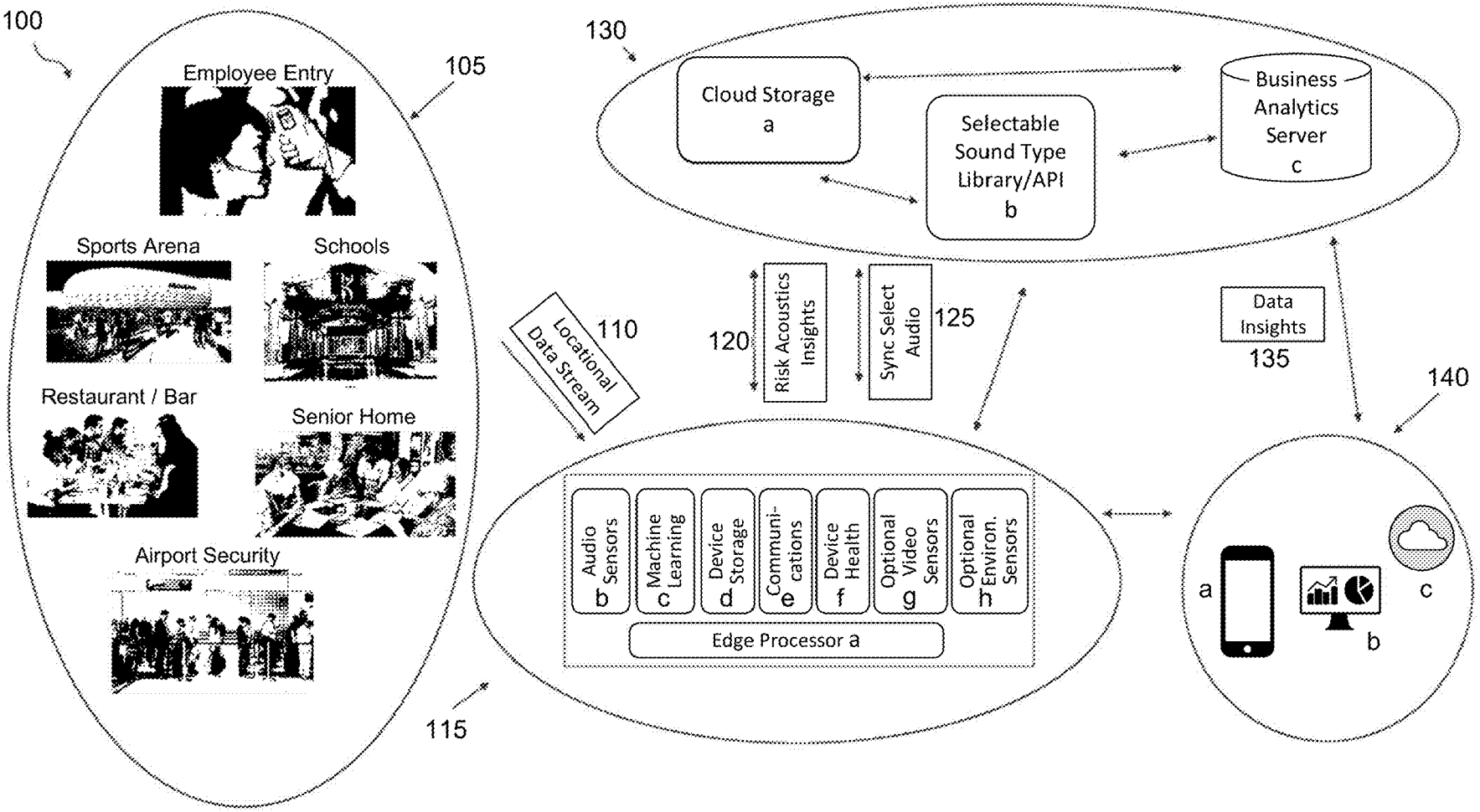
FIG. 1 illustrates an example of an implementation for surveillance of audio streams, in accordance with various embodiments of the present disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrases "for example," "such as," "including" and the like are used herein, the phrase "and without limitation" is understood to follow unless explicitly stated otherwise.

The terms "comprising" and "including" and "involving" (and similarly "comprises" and "includes" and "involves") are used interchangeably and mean the same thing. Specifically, each of the terms is defined consistent with the common patent law definition of "comprising" and is therefore interpreted to be an open term meaning "at least the following" and is also interpreted not to exclude additional features, limitations, aspects, etc.

The term "about" is meant to account for variations due to experimental error. All measurements or numbers are implicitly understood to be modified by the word about, even if the measurement or number is not explicitly modified by the word about.

The term "substantially" (or alternatively "effectively") is meant to permit deviations from the descriptive term that do not negatively impact the intended purpose. Descriptive terms are implicitly understood to be modified by the word substantially, even if the term is not explicitly modified by the word "substantially."

In broad constructs, the disclosure relates to devices, systems, and methods of conducting real time or near real time surveillance of a location of interest derived from an audio stream generated from that location via analysis of the audio stream to detect one or more sound types of interest. Some or all of the locational audio stream can be acquired and processed via machine learning processes that are at least partially, and in some implementations, fully resident on a device that is located on or proximate to the monitored premises. In this regard, one or more devices that incorporate each of audio stream capture, audio stream processing, and communications functionality can be installed proximate to the location of interest. The sound type(s) of interest for detection at the location can be selected from a library of sound types. The sound types can comprise either or both of human sounds or non-human sounds that are selected as being relevant to a particular location or business, as is discussed hereinafter.

In a significant example, the acquired audio stream comprises at least two audio sources, such as one or more humans, one or more animals, one or more machines, or one or more objects, or a combination thereof. In this regard, the audio stream of interest acquired from a location comprises a plurality of individual audio streams from a plurality of source that together comprise a "locational audio stream." The methodology herein has the benefit of being able to identify the presence or absence of at least one sound type of interest from the locational audio stream. Such identification can be conducted substantially on onsite at the location of interest in real time using the edge computing methodology herein.

The exemplary sound types that may be of interest for detection at a location are expansive, and will be relevant to the location in context. As non-limiting examples, the following categories of sounds, and sound types, can be of interest for detection in a particular location:

- Health: Cough, sneeze, sniffle, gasp, throat clearing, wheezing;
- Security—Terrorism (Active Shooter): gunfire, explosion;
- Environment: alarm alerting, doors slamming, windows/glass breaking, fire sounds (e.g., crackling), water flow (e.g. water flowing or dripping through faucet, pipe), machine operating or not operating; and
- Group or Individual distress: screaming, crying, mass running, excited, happy, anger, yelling, profanity, threats, fighting.

Sub-categories or sub-classes of these and other categories can also be generated; for example, categories or classes of type of coughing, types of crying, or type of glass breaking can be discernable from the locational audio streams. Additional information about the sound types will be provided hereinafter.

With respect to the edge computing methodology that forms a significant aspect of the present disclosure, substantial benefits can be provided over methodologies that require sound processing and analysis to take place at an offsite location, such as on a cloud computing server or the like. In an implementation, the locational audio stream—that is the audio stream comprising a plurality of sound sources obtained from at least two of humans, animals, machines, objects or a combination thereof collected in a single audio stream acquired from a location of interest—can be automatically segregated into individual audio tracks on the device by audio processing capabilities resident thereon. For example, a high pass filter can be applied to the audio stream prior to processing of the audio for sound content. As would be appreciated, such segregation of different sound sources into separate audio tracks can enable the detection of a sound type of interest from a locational audio stream that includes a plurality of sound types therein. However, such segregation is not necessary as long as the system can identify a sound type of interest from the entirety of the locational audio stream that comprises two or more sounds having different sources or origins.

In a substantial benefit, notification of the presence of a sound type of interest can be provided from a device located at or near the point where the locational audio feed is generated, that is, on the premises or proximate thereto. The ability to detect the sound type(s) of interest at a location can thus be substantially independent on a network connection to a cloud server or other communications methodology, such as Wi-Fi or cellular connection, to perform the various steps of the methodology herein. In accordance with the surveillance device, system, and method improvements herein, sound processing and analysis capability can be substantially resident on the device from which the audio stream is acquired. The surveillance devices having utility for the present disclosure can be configurable to process high density audio data and, optionally, other types of sensor data (e.g., video data, thermal data, environmental data) to identify the sound type(s) of interest therefrom, as well as other relevant data associated therewith, substantially without the need to upload the subject data streams to a separate device.

The edge computing capability operational with the surveillance devices of the present disclosure incorporates robust and modular artificial intelligence (AI) and machine learning capability. For example, when the sound libraries that are operational to provide identification of the sound type(s) of interest in the locational audio stream are configured with sound types of interest in a particular use case, where such sound types are associated with classifiers, feature sets, processing instructions, etc. relevant thereto, such use case-specific functionality can be incorporated into the surveillance devices themselves.

Moreover, when the sound libraries are enhanced or modified, the upgrades can be communicated to the surveillance devices from time to time. When the sound library information is modified or enhanced on a surveillance device with new sounds that can be relevant to subsequent sound analysis events, such enhancements can be transmitted to the sound libraries for distribution as appropriate to other devices operational in other environments when such sounds have been processed to generate relevant information. In this regard, when an acquired sound cannot be suitably analyzed on an on-site device, the acquired sound can be uploaded to another device and presented to a human reviewer for detection. The human reviewer can evaluate the sound and validated information relevant thereto can be incorporated into the sound libraries for future use.

The surveillance devices of the present disclosure can comprise hardware configured for edge computing, as would be appreciated by one familiar with IoT devices. Processing capabilities can be provided, for example, by a Raspberry Pi processor that is configured to be in communications engagement with a sensor having audio stream acquisition capability. The Nvidia Jetson® series of processors can also suitably be used. Such audio stream acquisition capability can be provided by a microphone configured in a single device packaged with the edge computing processor and other componentry such as with a microphone that is in communications engagement with sound processing functionality resident in a standalone device. Yet further, one or a plurality of wireless microphones can be in communications engagement (e.g., connected by WIFI, Bluetooth, or RFID) with the device having onboard sound processing capability, as long as the configuration of the microphone(s) as a separate component that is in communications engagement with the processor transmits the sound of interest to the device for processing substantially without latency. The use of a plurality of wireless microphones that are in communications engagement with the device configured for at least some onsite sound processing can facilitate the collection of one or more locational audio streams from different vantage points in a single location or business. The surveillance device can comprise other relevant electronics features, such as amplifiers, sound generation capabilities (e.g., lights or alarms), as would be appreciated.

The surveillance devices will also require a power source. In some implementations, the devices can be connected to a power source, such as via connection to an electrical power outlet, USB power source, or external battery. When connected to a power source, the devices can incorporate a battery backup. In other implementations, the power source for the on-location surveillance device can be a rechargeable battery, such as a lithium ion battery. It would be appreciated that the real-time or near real-time surveillance functionality of the devices typically would require that the devices be connected to power at all times the devices are intended to capture and process a locational audio stream. As such, the devices can be configured to provide a notification or alert when the battery power is removed from the power source, the battery is depleted, or the device is otherwise non-operational.

When the surveillance devices are battery powered, the componentry can be characterized as "low power," in order to extend the time that the device can be operational without needing to replace or recharge a battery.

In some implementations. methods to reduce the computational complexity needed to acquire, analyze, and, if appropriate, provide notifications associated with the sound type of interest can be used. Notably, because the sound types of interest for identification from a locational audio stream will, by definition, be those that are relevant in context to the user, manager, supervisor, or owner of the location or business from which the audio stream is being acquired and analyzed, the scope of the machine learning libraries from which the sound types of interest are generated can also be streamlined. The machine learning libraries that are operational on the surveillance device can thus be "fine-tuned" to allow the sound type identification to focus on one or a plurality of use cases where sound types derived from a location may be of interest for analysis and detection of the type, source, and reason therefore.

The selectability of sound types of interest in a particular situation from the library of sound types can facilitate the operation of the machine learning processes in the edge computing environment at least because the machine learning processes can be selected specifically to address the sound types relevant to a particular location or business type. This can result in a "lighter," more efficient and streamlined operation of a machine learning process that can be operational on the edge computing devices herein. In other words, the machine learning processes operational on each surveillance device at a location or business type can include only those sound types present in the sound libraries that are relevant thereto where such sound types can be selected for a location where surveillance is desired.

For example, a security line operation in an airport may not need capabilities to identify breaking window glass, whereas a retail establishment needing to identify security breach events that occur after hours may need such capabilities. In another example, a college may not need capabilities to identify sounds relevant to a day care operation or to a senior care center. Thus, the sound types of interest for a particular location or business can be specifically selected for incorporation on each surveillance device that is operational in a location in need of surveillance.

The scope and content of the sound libraries that are made available for operation on the surveillance devices for processing on the edge computing infrastructure can be kept reasonably streamlined in each specific use case, at least in comparison to a sound learning that can be expected to be able to identify a more generalized and non-specific number of sound types. The selection of the sound types of interest for a particular location or business therefore provides at least the benefit of enhancing the functionality of the surveillance devices when the locational audio stream processing is conducted on the device itself.

The operation of the locational audio stream on the surveillance device itself provides marked improvements over existing sound identification methodologies using automated sound processing technology. By way of explanation, current cloud computing architecture can be suboptimal for applications that require immediate processing results—that is, that are provided in real time or substantially in real time. Public cloud infrastructure increases latency compared to on-premises performance, as is provided with the present methodology. It has been determined by the inventors herein that the surveillance systems of the present disclosure provide needed improvements via a near instantaneous processing of the locational audio stream on a device located at or proximal to the location of interest at least because notifications of the occurrence of sound types associated with adverse events can be provided as quickly as possible so as to allow the elimination or, at the very least, mitigation of risk for the subject location or business.

To address latency present in prior art methods, the present methodology incorporates an edge computing capability in the devices that perform the collection and analysis of the locational audio streams. The edge computing capability of the devices of the present disclosure does not completely eliminate the need for cloud computing infrastructure or other processing outside of the devices (e.g., uploading to an on-premises server such as might be required to comply with data privacy considerations). The full sound libraries from which the specific sound libraries for the use case can be selected will still reside in on a cloud server on an on-site server. However, the ability to process locational audio data ingested onsite can reduce the data volume that needs to be uploaded and downloaded from the cloud or another server/computer, thus allowing real time or near real time processing of one or more sound types of interest, as well as the generation of real time or near real time notifications associated therewith.

This immediacy or near immediacy in sound type processing provided by the present methodology enhances the functionality of the surveillance devices herein in each use case. This immediacy more closely mirrors or approximates the onsite presence of a human who is observing a location in real life. By way of explanation, a human watchman present to hear the sound in real life would be able to respond in real time to the sound upon hearing via her human auditory processing capabilities. Similarly, the surveillance devices of the present disclosure can process the locational audio stream at or near the location where the audio stream is generated so as to provide a substantially real time notification of the presence or absence of a sound type(s) of interest.

The edge computing capabilities herein also facilitate independent operation of the locational audio stream acquisition, processing, and notification devices at or near the location of interest. The surveillance devices can operate in a standalone fashion that can be less susceptible to external forces that can reduce the effectiveness or even prevent the operation thereof, such as loss of electrical power and/or loss of broadband or cellular access. In this regard, the self-contained operation of the surveillance devices of the present disclosure can reduce opportunities for nefarious characters or problematic circumstances to render the surveillance devices non-operational. To this end, the surveillance systems of the present disclosure can be configured to be substantially independent of a power source that is not a battery power source. Moreover, the surveillance systems of the present disclosure can be configured to acquire, process, and, if appropriate, to provide a notification of the presence or absence of a sound of interest in a locational audio stream and, optionally, supplementation with one or more of video data, thermal data, or environmental sensor data, without the need to upload the subject data streams to a cloud computing device.

Given the mission critical nature of many surveillance activities, the ability to process audio and, optionally, video information on location in a manner that can be substantially independent of the ability to communicate with a cloud server prior to generating an analysis of a locational audio stream can increase the speed with which notifications can be provided. In turn, this can greatly improve the reliability of an onsite surveillance process. Notably, often data streams will be queued up for processing in a cloud server. Thus, depending on the traffic present in a subject cloud server environment, substantial time delay could be experienced. If one or more sounds of interest are identified from the locational audio stream from on-premises analysis thereof, a notification can be provided to a user, a device, or a computer of the presence of the sound(s) of interest substantially in real time. To facilitate this operation, the surveillance devices can be configured with capability to communicate directly to a user or computer without the notification being uploaded to a cloud computing server.

For example, if a sound type of interest for identification at a location or business comprises a gunshot, it would be necessary for notification of the occurrence of this sound to be generated substantially immediately to a manager, supervisor, or owner of the location to allow any business risk associated therewith to be mitigated or even prevented. It can also be relevant to provide notification of such an identified sound to a security operation or to the police. If the locational audio stream in which the gunshot is embedded first needed to be uploaded to a cloud server for analysis of whether a target sound was identified in therein and, if present, the notification then needed to be transmitted from the cloud server to a person, device, or computer, etc., significant time delay could be experienced between the occurrence of the gunshot and any ability to react thereto.

In a further implementation, the surveillance devices can be operational on a mobile device, such as a Smartphone, tablet, or other multi-functional device. The onboard microphone(s) associated with such devices used to obtain the locational audio stream or a device can be operational with one or more microphones configured within the location of interest. When the surveillance capabilities are included in such a device, the functionality is otherwise the same, however, the edge computing capability associated with a standalone surveillance IoT device can be supplanted by the multi-functional device. While the computing capabilities operational on a mobile device may be greater than obtainable with currently available edge computing device configurations, the more streamlined machine learning processes associated with selection of a specific sound type(s) of interest for detection, as well as the immediacy of processing, can provide notable benefits for the surveillance devices, systems, and methods herein over existing automated audio stream analysis methods.

A further notable aspect of the disclosure herein is the types of locations that the surveillance systems for which the methodology is substantially indicated. In this regard, the locations of interest are those in which surveillance would be relevant in determining whether the presence of a sound type can impart at least some business or personal risk to a user, supervisor, manager, or owner thereof. The relevant use case that defines the sound type(s) that are of interest for identification for the location of interest can be relevant to one or more business risks that may be associated with or that may result from the presence or absence the selected sound type of interest from the location.

As would be appreciated, the phrase "business risk" will be relevant in context for each location or business individually. Thus, the sound type(s) selected for identification in each locational audio stream may vary according to each business or location. The sound types of interest to be identified from an audio stream at the location of interest can be selectable from a library of sound types, where the sound types identifiable therefrom are configured with labels or tags that allow the sounds to be identified from the subject locational audio streams.

A wide variety of machine learning processes can suitably be used to generate the sound type identifications on the surveillance devices. For example, Google's Tensor Flow and Tensor Flow Lite, or Microsoft's EdgeML can be incorporated onboard the surveillance device for processing on the edge computing functionality, for example. Similarly, if the surveillance system is resident on a mobile device, such as a smartphone, a suitable machine learning process can be utilized. Activities associated with creating onboard machine learning capabilities for edge computing devices and mobile devices is an ongoing area of research today. It is expected that improvements will be generated in this area in the future, and such new developments are contemplated for use herein.

In some situations, the absence of a sound type of interest from a locational audio stream may be indicative of a business risk. For example, if the sound type of interest is a fan needed to cool electronic equipment, the absence thereof can indicate that equipment failure may result. Such sound type can be selected from the library of sounds for incorporation onto a surveillance device located in or proximate to the location of interest.

Such "negative sound type" selection can be combined with a "positive sound type" from the sound library. In this regard, breaking glass can be a positive sound type such that its presence is of interest to note in the locational audio stream, whereas the absence of the fan sound can be the negative sound type. Thus, the machine learning processes can be configured with sound libraries configured with sound types that can allow identification of both of these positive and negative sounds as the sound types of interest in a locational audio stream. Both sound types would indicate that a business risk may occur at the subject location when the breaking glass sound is detected, whereas the absence of the cooling fan sound would also be relevant to the business risk that may occur for the location.

The self-contained nature of the surveillance devices of the present disclosure can allow a degree of portability thereto. Moreover, the sound processing capability that can allow detection of a sound type(s) of interest from a locational audio stream can be added or removed from the device by a user. This can allow a surveillance device to be configured for not just each location of interest, but also for a situation or event of interest. For example, the same device can be used for surveillance in a basketball arena, as well as in a daycare center. The difference between the sound types that may be of interest in each of these locations can be significant. However, the functionality of a specific device can be modified as needed for a situation or location by selecting a relevant sound type for an event or location from an available sound type library as needed and incorporating the analysis and notification functionality on the device as needed.

The devices, systems, and methods herein relate broadly to any location that can benefit from substantially real-time audio and, optionally, video and/or environmental surveillance thereof. The locations of interest can comprise those that are subject to visitation by customers or patrons for which goods, services, or activities are provided, such that their "business" is the providing of goods, services, or activities to a group of people. The services or activities that are provided by a business at a location can be either or both paid for or free. As would be appreciated, such locations can be expansive.

To this end, the locations can be businesses that are offering goods or services to customers or patrons for which payment is or might be obtained (e.g., grocery stores, medical offices/facilities, department stores, shopping malls, restaurants, warehouses, movie theaters, concert venues, sports arenas, etc.). The business risks associated with these types of locations can be an inability to meet financial goals because of a loss of customers due to unsafe or unhealthful conditions present at the location. Another business risk for such locations can be legal or financial liability that results from unsafe conditions at the location in which a patron or customer may be injured or when an employee is unable to work and/or when a first employee harms another employee, etc.

Yet further, the locations of interest can comprise locations where people congregate for services or activities but that are not generally considered to be "businesses," such as churches, schools, community centers, or the like. As to these examples, "business risks" can also be imparted by the presence of a sound type(s) in the location of interest may need to close or reduce operations if the risk is present. For example, if a church goer is found to have a cough having characteristics associated with of Covid-19, other church goers may be at risk of being infected. Such risk will require the church to shut down, or to at least introduce social distancing rules that will reduce the capacity of in-person church services. As another example, if a community center that provides services to senior citizens cannot remain open due to the presence of unhealthful conditions, this facility will not be able to suitably conduct business. Thus, there is a "business risk" that can be detected by the identification of a target sound type associated with the presence or absence of an unhealthful condition at the location.

Sound types of interest in a location can comprise one or more of human or non-human sounds. The sound types of interest can be associated with an adverse or unhealthful human health condition. The sound types of interest can be associated with an adverse or beneficial safety condition.

The sound type of interest can be selected from a library of sounds associated with business risk categories. The type of human sounds that are of interest that can be included in the library of sounds associated with business risk are expansive. In non-limited examples, the human sounds can include: infant, child, or adult screams, crying, coughing, clapping, whistling, sneezing, wheezing, footsteps, or laughing. The type of non-human sounds that are of interest that can be included in the library of sounds can include gunshots, explosions, breaking glass, alarm bells, door slams, keyboard typing, objects dropping, and washing of hands, etc.

In an implementation, when a sound type of interest is identified from a locational audio stream, the duration of the sound can be included in the notification. For example, if a human sound such as a scream or cry is detected, the length thereof can be indicative of whether a business risk is associated thereto. In this regard, a human scream x or cry $x^1$ having a duration of y seconds can be provided in the notification.

In a further implementation, when a sound of interest is identified at a location of interest from an audio stream generated therefrom, the number of times that the sound is detected between a first time and a second time can be included in the notification. For example, a human scream that occurs a plurality of times in a period of time can be denoted "human scream happened x times in y minutes" can be generated.

Still further, if a sound type is identified as a human scream from a location of interest, there may be more than one individual from whom the screams originated. The audio stream analysis engine can thus be configured to denote a first scream having a duration of x seconds from a first individual (e.g., "individual one") and a second scream having a duration of y seconds from a second individual (e.g., "individual two"). Similarly, the audio stream analysis engine can be configured to identify different non-human sounds by an arbitrary category. For example, if two different sounds are identified from the audio stream at the location of interest, each sound can be identified as "object having sound characteristics A" and "object having sound characteristics B" can be provided.

Notifications via the device sound processing can be directly dispatched from the device to a user, computer, or both substantially in real time, or the notifications can be stored on the device and/or uploaded to a cloud computing server. When a notification of the presence of a sound type(s) of interest is automatically generated by the surveillance device, such notification can be automatically provided to a user, supervisor, manager, or owner of the location, such as to a mobile or wearable device. As would be appreciated, the more immediate that a notification can be, the more quickly the user, owner, supervisor, or manager can react to mitigate or prevent any damage that may be associated with the identified sound type. It follows that such immediacy in providing the notifications can allow the surveillance devices of the present disclosure to more closely simulate an in-person surveillance or supervision of ongoing and relevant activities at a business or location. Alternatively, or in conjunction with the notification, the information associated with the notification can be included in onboard storage on the surveillance device. In a further implementation, each notification can be uploaded either individually—that is, as each notification occurs—or a plurality of notifications can be stored onboard the device in bulk form and then uploaded as a plurality of individual notifications to a cloud storage system.

In some implementations, a full locational audio stream and, optionally, a video, thermal, and/or environmental data stream, associated with a time period of interest can be recorded. Since the storage available on the surveillance device itself may be constrained, such audio and/or other data streams can be uploaded to a cloud storage device or local server or computer as mentioned previously. The data stream can also be systematically deleted to create a full set of audio and/or video data using known methods, such as that described in U.S. Pat. No. 9,786,146, the disclosure of which is incorporated herein in its entirety by this reference.

When the notifications are uploaded to a cloud storage system or a local server or computer, a plurality of notifications can be configured for presentation to a user in a dashboard format to provide a user, manager, supervisor, or owner of a plurality of notifications with a concise overview of a set of notifications that have occurred at the subject location or business or at a plurality of locations or businesses that are of interest as a collection of notifications for review. Such a dashboard configuration can allow notifications from a plurality of locations or business to be monitored simultaneously as the notifications may be occurring substantially in real time or in a retrospective analysis.

For example, a collection of notifications configured in a dashboard form can be collected to generate actionable information for a user, manager, supervisor, or owner of different locations where conditions that could cause business risk individually or in the aggregate. Still further, the collection of a plurality of notifications can provide a concise reporting configuration for a security officer or company responsible for management thereof. The collection can provide information of an incident of concern at a single location or at a plurality of locations. In a further implementation, the collection of the plurality of notifications can provide a concise reporting format to a public service organization, such as a 911 Center or an emergency operations center for an organization. A retrospective review of an emergency situation that occurred in the past can also be provided by the dashboard configuration, as well as a database storage that can be queried for formatting into a report.

In addition to a dashboard configuration, notifications can be provided to a user on a mobile device, such as a smartphone. This feature can enhance the portability and flexibility of the surveillance devices, systems, and methods by allowing a user to obtain notifications as needed and, in implementations, substantially when the presence or absence of a sound type(s) of interest is identified in the locational audio stream.

The actions by a recipient of the notification that are made in response to the notifications can be recorded for use in further machine learning processes to further tune the processes to be used for a specific location or business or more generally for other processes. The user can also be asked to validate the notification, which can facilitate generation of a ground truth for the relevant machine learning content on the device and those in the cloud computing environment. For example, if a user indicates that a notification is incorrect or unwanted when provided, that response can be used to generate further notifications relevant to the sound type, location, business or user.

In a further implementation, retrospective data can be collected from notifications collected from analysis of a plurality of locational audio streams of a single location or business or a plurality of locations or businesses. Data associated from such notifications can be used to perform modeling of the circumstances known to be associated with the notifications to provide predictions that might be relevant to future planning of these circumstances that generated notifications determined to be associated with actual or potential business risk at the subject locations or businesses. For example, it might be determined that certain sound types of interest are more likely to occur at a particular time of day, day of the week, or time of the year. In another situation, it might be determined that a sound type(s) of interest more often occurs when a particular manager is onsite, or a particular student is in a specific classroom. In other words, the notification data generated from the surveillance devices can be used to develop strategies for improving operations of a location or business so as to reduce the potential occurrence of future business risk.

The machine learning systems can be configured to identify sub-characteristics of each sound type of interest that may be present in a locational audio stream. For example, not all coughs will be characterizable as potentially causing or influencing a "business risk" for the location of interest. A cough associated with a person's seasonal allergies may be benign as a business risk, whereas a cough having the characteristic sound associated with Covid-19 could generate a significant business risk. A sound of breaking glass that is indicative of a jar of pickles being dropped would indicate to a store supervisor that a clean up may be needed in an aisle in her grocery store, whereas a breaking glass sound type that is indicative of a large plate glass window breaking can be indicative of a burglary or weather damage occurring at the location.

The various characteristics or context for each sound type of interest can be labeled or tagged for use in the machine learning processes that operate on the surveillance devices, as well as being useful for the machine learning processes operational in the cloud computing environment. Such labeling or tagging can be conducted fully or partially by a human supervisor. In some cases, such as when the sound is associated with a health condition like a cough, an expert can conduct the initial tagging or labeling, or the expert can perform a validation/confirmation step after the sound type is labeled for a subclass or characteristic. The sound types can also be tagged for class and/or subclass can also be crowd sourced in that individuals can be asked to record sound and include and/or validate information about sound types present in the sound library that can be used in the machine learning processes that are operational on the surveillance devices of the present disclosure.

Previously recorded sounds can also be presented to individuals for crowd sourcing of sound identification. When presented for crowd sourcing, the recorded sound types can be tagged or labeled in the first order by a group of users. A previously tagged or labeled sound type recording can also be presented for validation of the labels or tags.

Sound type data that can be relevant to a location or business can also be collected from the specific location. For example, one or more locational audio streams can be acquired from a location of interest or from a single location in a group of similar locations (e.g., a single retail store in chain of the same brand of retail stores). The sound type(s) identified therefrom can be fully or partly reviewed by one or more persons with knowledge of the location or group of similar locations. The locational audio stream can be partially tagged or labeled prior to review by the one or more persons associated with the location of interest (e.g., employees, supervisors etc.) or the one or more persons associated with the location can be tasked with reviewing the locational audio stream to label or tag the sound types therein for use in the machine learning systems. Such labelling or tagging for a group of similar businesses or locations can be useful, for example, to maintain consistency in operations amongst a group of locations owned by a single company.

As would be appreciated, a machine learning process operational on the surveillance devices of the present disclosure would benefit from being updated from time to time to include new aspects and improvements generated in the machine learning processes. Such improvements can be sourced from other devices running in different locations. In this regard, a more expansive sound library can reside in a cloud computing environment, where that sound library is configured to collect information generated from the distributed sound processing that are operational in each of a plurality of locations on a plurality of individual surveillance devices. The sound learning libraries operational in the cloud computing environment can be configured to push updated sound library information relevant to a particular location to one or more of the individual surveillance devices distributed among different locations from time to time. In a further implementation, a plurality of sound libraries can be operational in a cloud computing environment, where such processes can be in communication therebetween, such as via one or more APIs configured to be operational on the distributed surveillance devices. Sound type libraries can be moved through and among surveillance devices operational at different locations via API, as would be appreciated in the context of IoT frameworks.

The sound type libraries operational on the surveillance devices of the present disclosure can be provided for purchase as a function of the class or type of sound types in marketplace or "app store" environments. For example, a daycare center can purchase a sound type library for operation on the surveillance device operational therein where the selectable sound type library is relevant to the business of the daycare center. As a further example, a grocery store can purchase a sound type library for operation on the surveillance device that is relevant to the specific operations of the grocery store. When such sound type "packages" are selected for use in a specific location or business, sound processing characteristics appropriate for the subject location can be incorporated on the relevant surveillance devices to provide a "plug and play" process that can be operational substantially without the need for machine learning or sophisticated computer expertise.

Alternatively, sound type libraries can be custom-created for a specific location or business as necessary. For example, an operator of a live performance venue may be interested in reducing the occurrence of phones ringing in the theater and can obtain the subject sound type for its own specific business case for operation on a surveillance device therein. Sound processing capabilities associated with the "bespoke" needs of a specific location can be pushed to the surveillance devices, also as a "plug and play" configuration. Such custom generated sound library types can be incorporated into the sound type library marketplace for use by other locations or businesses.

As noted, the surveillance devices of the present disclosure can be associated with a video sensor. Sensors capable of tracking movement or tracking individual humans, animals, or moving objects (e.g., vehicles) or to obtain thermal data via infrared sensors can also be associated with the surveillance devices. Yet further, environmental sensors can be associated with the devices to generate additional information that can be relevant to the conditions present in the location or business. Such collection of environmental information (humidity, temperature, carbon dioxide, carbon monoxide etc.) can provide further context to the information derivable from the locational audio stream. Information derivable from the interaction of the locational audio stream and data obtainable from other associated sensors can be used to enrich the information obtainable from the surveillance devices.

In specific use cases currently contemplated by the inventors, the devices, systems, and methods of the present disclosure can enable objective, substantially real time detection of health or other conditions of human, animals, machines, and objects via audio streams generated at a location of interest via acquisition and analysis of an audio stream obtained from that location. By "objective," it is meant that a user, employee, supervisor, manager, or owner will herself not be required to identify and respond to a specific sound directly from the sound. Rather, the analysis of sound types that have been identified as potentially causing a health, safety, or operating concern—that is, a "business risk"—can be automatically acquired, analyzed and assessed for relevance in context by a computing device. Thus, adherence to managerial, compliance, and safety rules can be better ensured because the human factor can be fully or partially eliminated from analysis of the occurrence of a sound type(s) in an environment in need of surveillance for circumstances where at least some of the associated risk is assessible by one or sound types.

The systematic and objective collection of sound type information from each of a plurality of individual locations or businesses according to the devices, systems, and methods of the present disclosure can enable a number of institutional improvements related to the management of business risk in a variety of business environments. In non-limiting examples, the information generated herein can facilitate:

- Activation of a safety response more quickly as appropriate for a location of interest in context;
- Provide substantially immediate notification of an incident of interest at a specific location to users or systems in need of such information;
- Ensure consistent compliance of applicable policies and procedures at individual locations;
- Facilitate the generation of legal documentation for an event if appropriate for a notification;
- Activate supervisory support if appropriate; and
- Enhance and normalize training.

In an implementation, the locational audio streams can be associated with, for example, a grocery or retail store to allow one or more of employees, supervisors, managers, or owners to understand whether one or more conditions that could be associated with a business risk may be present at the location. The locational audio stream can be used to answer questions such as:

Is there a health risk in my store?

Is there a security risk in my store?

Is there a liability risk in my store?

Is there a customer that is in distress or displeased with a condition in my store?

In a further implementation, the locational audio streams can be associated with an educational institutional environment to help teachers, administrators, or others to understand whether one or more conditions that could be associated with a business risk may be present at the location. The locational audio stream can be used to monitor school entry conditions, classrooms, lunchrooms, assemblies, sporting events, playgrounds, stadiums, etc. The locational audio streams can be acquired and analyzed, and any notifications can be provided therefrom from surveillance devices that are positioned through and among the location(s) of interest in the school or educational institution. The locational audio stream can be used to answer questions such as:

Is there a health risk entering or in my school or school environment?

Is there a security risk in a particular school or location in the school?

Is there a student in distress or an upset parent in the school?

A further implementation for the devices, systems, and methods of the present disclosure can comprise safety and security monitoring at the entrance or other area of at a location of interest. In non-limiting examples, this can include, airport security, sporting or concert arena entry areas, amusement parks, cruise ships, customs and immigration entry points, office entry points, or the like. Security officers (e.g., ICE officers, TSA agents, security guards, etc.) can be notified when a sound type of interest is identified from a locational audio stream at a location. In some implementations, the audio stream can be associated with a video feed that can allow the source of the identified sound to be matched with an individual. For example, an identified cough having characteristics that is potentially associated with a communicable disease can be matched with a video feed generated substantially simultaneously to allow the individual who emitted the cough to be individually examined, such as by heightened screening. By providing a more focused analysis of individuals who may be more likely to have a condition associated with a business risk—here the potential for transmission of a communicable disease—the number of people who need to be individually examined can be reduced. As would be appreciated, such a more focused and purposeful screening of individuals can reduce wait times for others, as well as reduce the staffing that may be needed when every person entering a secured location needs to be individually screened.

In a further use case, the devices, systems, and methods herein can have utility in monitoring restaurant and fast food locations. Customers who are dining in a restaurant can be monitored for health or safety related conditions that may be associated with business risks to the subject business location. Customers in ordering queues can also be monitored. Employees who are serving customers can be monitored, as well as those who are working in food preparation areas.

The ability of a food service location, as well as other locations that rely on customer visits for revenue, to assure customers and patrons that the location is being continuously monitored for potential health and safety issues can enhance confidence that patronizing this location will be unlikely—or at least less likely—to cause an adverse health or safety result for the person. Thus, the "business risk" associated with loss of revenue can be reduced with use of the surveillance systems of the present disclosure in this and other similar situations. Moreover, such monitoring is objective and consistent, which means that health and safety compliance can be better maintained.

A further use case for the devices, systems and method of the present disclosure include employee health monitoring. As would be appreciated, employers may hold liability for maintaining the health of workers. Moreover, if a work force becomes ill, business cannot be conducted efficiently. Thus, there is a business risk caused by not knowing whether one or a population of employees may be ill. The devices, systems, and methods herein can be implemented in entry screening process in work place settings, such as when an employee uses their badge to enter each day. Yet further, surveillance devices can be located throughout a work place location to continuously monitor locational audio streams during a shift. This can facilitate the support of the health and safety of employees, as well as those who come into contact with these employees.

Besides allowing health risks or concerns to be monitored in a work place environment, the present disclosure can facilitate consistent compliance of human resource policies and procedures, as well as to enhance the generation of appropriate legal documentation of a health, safety, or compliance-related event, if appropriate.

In a further use case, senior care homes can be made more safe with the surveillance devices, systems, and processes of the present disclosure. In this regard, common areas where illness may be spread from resident to resident can be monitored for unhealthful situations. Moreover, residents who may be experiencing distress can be identified even though an employee may not be located nearby. For example, a resident who falls may emit a painful cry that can be identified to allow a notification to be generated to an employee. A "pain cry" will normally have different characteristics than a cry of joy or happiness; thus, the cries can be distinguished by sub-class and notifications be provided as appropriate for the nature of the associated risk. Health conditions such as coughing, and subclasses of coughs, can be identified. This capability in a senior care environment can allow more immediate help to be provided to the person in need of care, as well as to reduce the spread of communicable diseases. In regard to the "business risk" for the senior care home, health and safety related information is collected by regulatory agencies and, when appropriate, the care location may be fined or otherwise penalized for such incidents. The systems and methods can therefore improve the ability of senior care homes, as well as other care based businesses, to react to situations that affect the health and safety of their residents, even while such businesses need to maintain as low a staffing cost as possible given the low profit margins of such businesses.

FIG. 1 illustrates surveillance system 100. Collection 105 illustrates an assortment of location/business types, which is meant to be a non-exhaustive list, from which a locational audio stream, as well as other sensor data (collectively "locational data stream 110") can be generated for analysis thereof to identify one or more sound type(s) being present or, in some, cases, absent. Surveillance device 115 comprises edge processing capability 115*a*, audio sensors 115*b*, sound processing capability 115*c*, local device storage 115*d*, communications 115*e*, device health 115*f* (e.g., electrical and/or battery power), as well as optional video sensors 115*g* and environmental sensors 115*h*. As mentioned, a mobile device can also provide the surveillance device functionality of the present disclosure. After a locational data stream is processed by device 115 to identify the presence or absence of one or more sound types(s) that may be present in a locational audio stream, risk acoustics insights 120 and at least some synced audio 125 is communicated to and from offsite computing capability 130, which comprises cloud storage 130*a*, selectable sound type library 130*b*, and business analytics server 130*c*. Data insights 135 can be communicated directly to and from one or more data reporting and storage locations 140 from surveillance device 115 and/or from offsite computing capability 130. Data reporting and storage locations 140 can comprise mobile device 140*a*, dashboard 140*b*, and database storage 140*c*.

Figure 2:
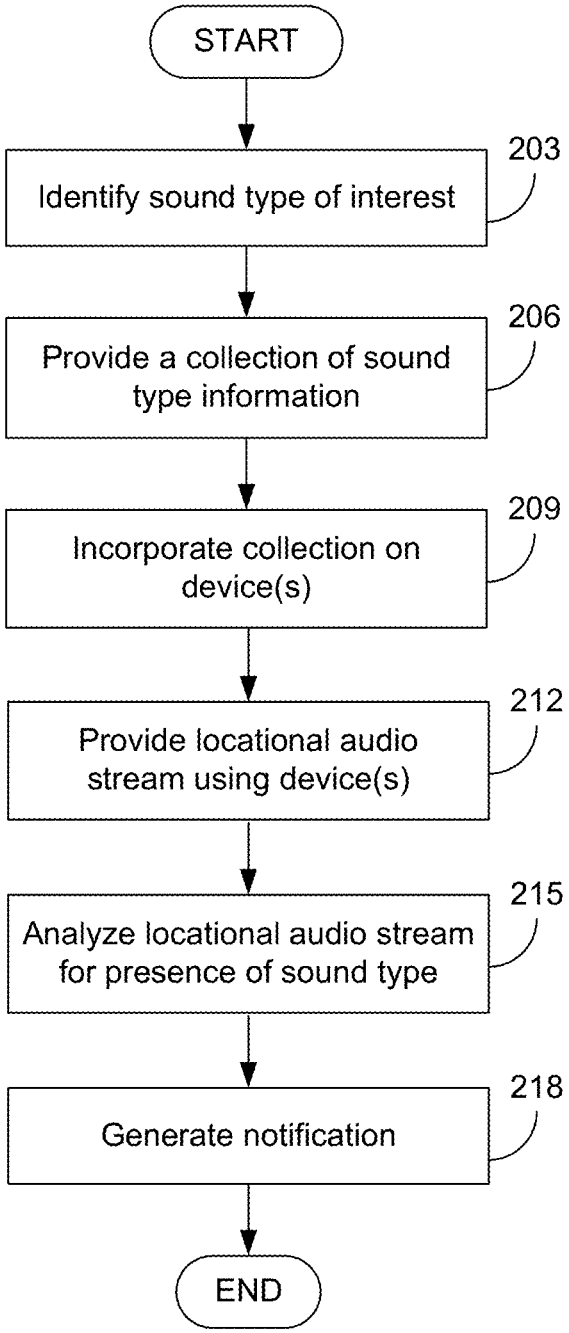
FIG. 2 is a flowchart illustrating an example of a process for surveillance of audio streams, in accordance with various aspects of the present disclosure.

Referring to FIG. 2, shown is a flowchart illustrating an example of a surveillance methodology as disclosed herein. The methodology can be used for conducting real-time surveillance of a location of interest from an audio stream. Beginning at 203, presence or absence of one or more sound types of interest at a location during a time period can be identified. A collection of sound type information can be provided at 206. For example, the collection can be provided by selecting (by a user, or a computer, or both) one or more sound types of interest from a library of sound type information. The collection of sound type information can then be incorporated into one or more device(s) proximate to the location at 209. The one or more devices can be individually or collectively configured with sound acquisition, sound processing, communications, and storage capabilities. The collection can be stored on the device(s).

A locational audio stream can be provided at 212 by acquiring an audio stream from the location with one or more of the device(s). At 215, the locational audio stream can be analyzed to determine whether one or more of the sound types in the collection of sound type information is present in the audio stream. At least some of the locational audio stream analysis can be conducted by processing the locational audio stream via edge computing capability operational on the one or more devices without first uploading the locational audio stream to a cloud computing server or other computing device. A notification can be generated at 218 if one of a sound type in the collection of sound type information is present in the locational audio stream. The notification can be generated and communicated to a user or computer directly from one of the devices.

Figure 3:
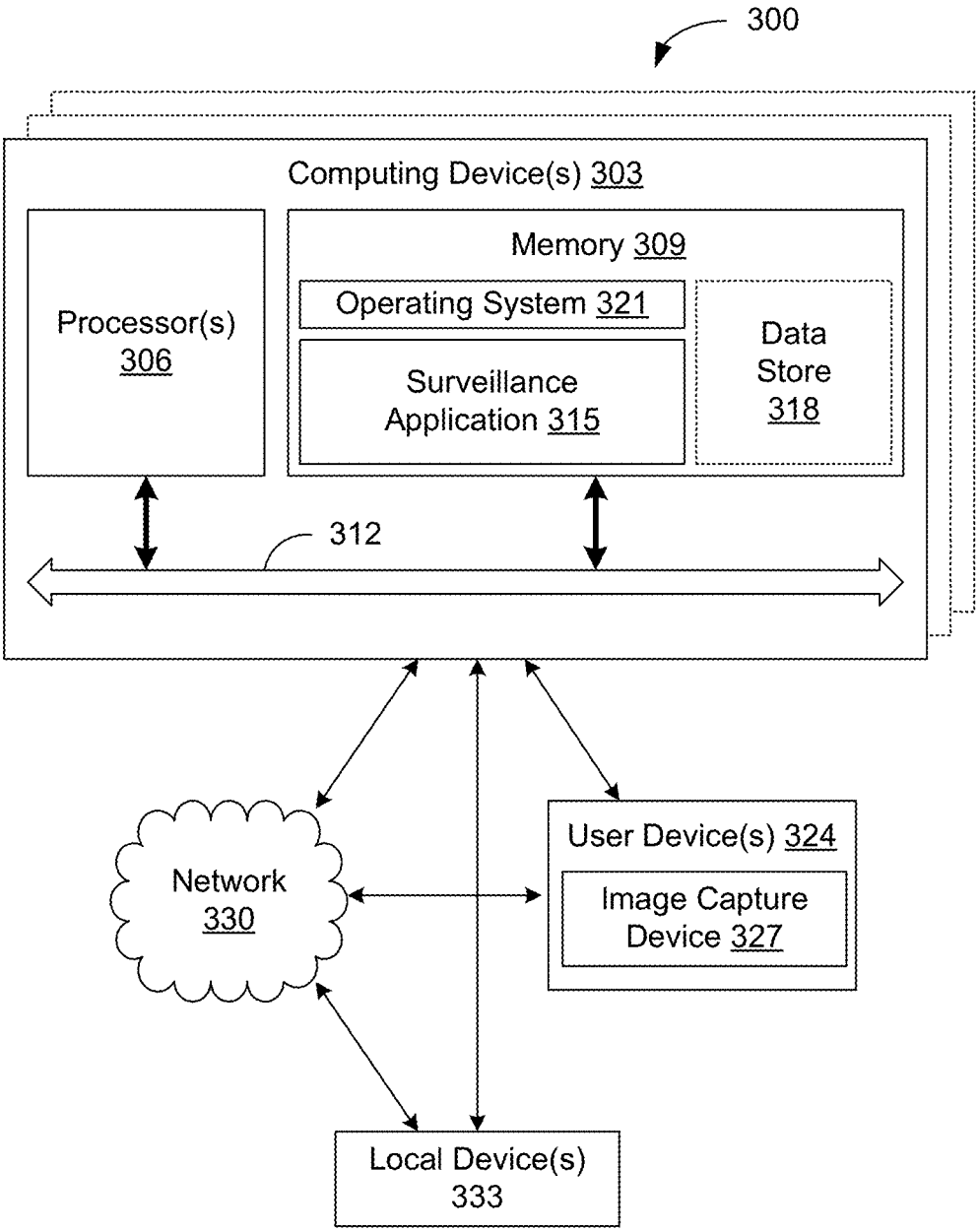
FIG. 3 is a block diagram illustrating an example of a system that can be used for surveillance of audio streams, in accordance with various aspects of the present disclosure.

Referring now to FIG. 3, shown is an example of a system 300 that may be utilized for the surveillance methodology disclosed herein. The system 300 can be one or more computing device(s) 303 or other processing device(s), which includes at least one processor circuit, for example, having a processor 306 and a memory 309, both of which are coupled to a local interface 312. To this end, the computing device(s) 303 may comprise, for example, a server computer, mobile computing device (e.g., laptop, tablet, smart phone, etc.) or any other system providing computing capability. The computing device(s) 303 may include, for example, one or more display or touch screen devices and various peripheral devices. Even though the computing device 303 is referred to in the singular, it is understood that a plurality of computing devices 303 may be employed in the various arrangements as described above. The local interface 312 may comprise, for example, a data bus with an accompanying address/control bus or other bus structure as can be appreciated.

Stored in the memory 309 are both data and several components that are executable by the processor 306. In particular, stored in the memory 309 and executable by the processor 306 include a surveillance application 315 and potentially other applications. Also stored in the memory 309 may be a data store 318 and other data. The data stored in the data store 318, for example, is associated with the operation of the various applications and/or functional entities described below. For example, the data store may include databases, object libraries, and other data or information as can be understood. In addition, an operating system 321 may be stored in the memory 309 and executable by the processor 306. The data store 318 may be located in a single computing device or may be dispersed among many different devices. The components executed on the computing device 303 include, for example, the surveillance application 315 and other systems, applications, services, processes, engines, or functionality not discussed in detail herein. It is understood that there may be other applications that are stored in the memory 309 and are executable by the processor 306 as can be appreciated. Where any component discussed herein is implemented in the form of software, any one of a number of programming languages may be employed.

The system 300 can be configured to communicate with one or more user device(s) 324 (e.g., a mobile computing device or other mobile user device) including an image capture device 327 that can capture video and audio information or other audio recording capabilities. For example, the user device(s) 324 can be communicatively coupled to the computing device(s) 303 either directly through a wireless communication link or other appropriate wired or wireless communication channel, or indirectly through a network 330 (e.g., WLAN, internet, cellular or other appropriate network or combination of networks). In this way, acquired video and/or audio information, library information or other information can be communicated between the computing device(s) 303 and user device(s) 324.

The system 300 can also be configured to communicate with one or more local device(s) 333 configured for surveillance of a location. The local device(s) 333 can be individually or collectively configured with sound acquisition capability; sound processing capability; communications capability; and storage capability. For example, the local device(s) 333 can be communicatively coupled to the computing device(s) 303 either directly through a wireless communication link or other appropriate wired or wireless communication channel, or indirectly through the network 330 (e.g., WLAN, internet, cellular or other appropriate network or combination of networks). In this way, acquired video and/or audio information, library information or other information can be communicated between the computing device(s) 303 and the local device(s) 333.

A number of software components are stored in the memory 309 and are executable by the processor 306. In this respect, the term "executable" means a program file that is in a form that can ultimately be run by the processor 306. Examples of executable programs may be, for example, a compiled program that can be translated into machine instructions in a format that can be loaded into a random access portion of the memory 309 and run by the processor 306, source code that may be expressed in proper format such as object code that is capable of being loaded into a random access portion of the memory 309 and executed by the processor 306, or source code that may be interpreted by another executable program to generate instructions in a random access portion of the memory 309 to be executed by the processor 306, etc. An executable program may be stored in any portion or component of the memory 309 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

Also, the processor 306 may represent multiple processors 306 and the memory 309 may represent multiple memories 309 that operate in parallel processing circuits, respectively. In such a case, the local interface 312 may be an appropriate network that facilitates communication between any two of the multiple processors 306, between any processor 306 and any of the memories 309, or between any two of the memories 309, etc. The local interface 312 may comprise additional systems designed to coordinate this communication, including, for example, performing load balancing. The processor 306 may be of electrical or of some other available construction.

Although the surveillance application 315, and other various systems described herein, may be embodied in software or instructions executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

Any logic or application described herein, including the surveillance application 315, that comprises software or instructions can be embodied in any non-transitory computer-readable medium for use by or in connection with an instruction execution system such as, for example, a processor 306 in a computer system or other system. In this sense, the logic may comprise, for example, statements including instructions and declarations that can be fetched from the computer-readable medium and executed by the instruction execution system. The flowchart or diagrams of FIG. 2 shows an example of the architecture, functionality, and operation of possible implementations of a surveillance application 315. In this regard, each block can represent a module, segment, or portion of code, which comprises one or more executable instructions for implementing the specified logical function(s). It should also be noted that in some alternative implementations, the functions noted in the blocks may occur out of the order noted in FIG. 2. For example, two blocks shown in succession in FIG. 2 may in fact be executed substantially concurrently or the blocks may sometimes be executed in a different or reverse order, depending upon the functionality involved. Alternate implementations are included within the scope of the preferred embodiment of the present disclosure in which functions may be executed out of order from that shown or discussed, including substantially concurrently or in reverse order, depending on the functionality involved, as would be understood by those reasonably skilled in the art of the present disclosure.

Communication media appropriate for use in or with the inventions of the present disclosure may be exemplified by computer-readable instructions, data structures, program modules, or other data stored on non-transient computer-readable media, and may include any information-delivery media. The instructions and data structures stored on the non-transient computer-readable media may be transmitted as a modulated data signal to the computer or server on which the computer-implemented methods of the present disclosure are executed. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term "computer-readable media" as used herein may include both local non-transient storage media and remote non-transient storage media connected to the information processors using communication media such as the internet. Non-transient computer-readable media do not include mere signals or modulated carrier waves but include the storage media that form the source for such signals.

In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

At this time, there is little distinction left between hardware and software implementations of aspects of systems; the use of hardware or software is generally (but not always, in that in certain contexts the choice between hardware and software can become significant) a design choice representing cost vs. efficiency tradeoffs. There are various information-processing vehicles by which processes and/or systems and/or other technologies described herein may be implemented, e.g., hardware, software, and/or firmware, and that the preferred vehicle may vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various aspects of the devices and/or processes for system configuration via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the aspects disclosed herein, in whole or in part, can be equivalently implemented in integrated circuits, as one or more computer programs running on one or more computers, e.g., as one or more programs running on one or more computer systems, as one or more programs running on one or more processors, e.g., as one or more programs running on one or more microprocessors, as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal-bearing medium include, but are not limited to, the following: a recordable type medium such as a floppy disk, a hard disk drive, a CD, a DVD, a digital tape, a computer memory, etc.; and a remote non-transitory storage medium accessed using a transmission type medium such as a digital and/or an analog communication medium (e.g., a fiber optic cable, a waveguide, a wired communications link, a wireless communication link, etc.), for example a server accessed via the internet.

Those skilled in the art will recognize that it is common within the art to describe devices and/or processes in the fashion set forth herein, and thereafter use engineering practices to integrate such described devices and/or processes into data-processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors, e.g., feedback for sensing position and/or velocity; control motors for moving and/or adjusting components and/or quantities. A typical data processing system may be implemented utilizing any suitable commercially available components, such as those typically found in data computing/communication and/or network computing/communication systems.

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

As described herein, the exemplary aspects have been described and illustrated in the drawings and the specification. The exemplary aspects were chosen and described in order to explain certain principles of the invention and their practical application, to thereby enable others skilled in the art to make and utilize various exemplary aspects of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. Other benefits can be provided with the devices, systems, and methods of the present disclosure.

What is claimed is:

1. A method of conducting real-time surveillance of a location of interest from an audio stream comprising:

a. identifying, by either or both of a user or a computer, a presence or absence of one or more sound types of interest at a location during a time period;

b. selecting, by either or both of the user or the computer, the one or more sound types of interest from a library of sound type information, thereby providing a collection of sound type information;

c. incorporating, by the computer, the collection of sound type information on one or more devices proximate to the location, wherein the one or more devices are individually or collectively configured with each of:

i. sound acquisition capability;

ii. sound processing capability;

iii. communications capability; and iv. storage capability for the collection of sound type information;

d. acquiring an audio stream from the location by the one or more of the devices, thereby providing a locational audio stream;

e. analyzing, by the one or more devices, the locational audio stream to determine whether one or more of the sound types of interest in the collection of sound type information is present in the audio stream, wherein at least some of the locational audio stream analysis is conducted by processing the locational audio stream via edge computing capability operational on the one or more devices without first uploading the locational audio stream to a cloud computing server; and f. generating a notification to the user or the computer if one of the one or more sound types of interest in the collection of sound type information is present in the locational audio stream, wherein the notification is generated to the user or the computer directly from one of the devices.

2. The method of claim 1, wherein the locational audio stream is generated from one or more sound types in the collection of sound type information comprising each of a human, an animal, an object, or a machine.

3. The method of claim 1, wherein at least one of the one or more sound types of interest in the collection of sound type information is selected from a library of sound type information associated with categories of business risk assigned to the location of interest.

4. The method of claim 1, wherein at least one of the one or more sound types of interest comprises one or more of:

a. a sound associated with a human health condition;

b. a sound associated with a human, animal, object, or machine safety condition; or c. a business compliance condition.

5. The method of claim 1, wherein audio stream acquisition capability is provided on each of the one or more devices by one or more wireless or wired microphones in communications engagement with the one or more devices.

6. The method of claim 1, wherein the one or more devices are in operational engagement with one or more of:

a. a video capture device; or b. one or more environmental sensors.

7. The method of claim 1, wherein additional sound type information is derived from each of a plurality of locational audio streams generated from a plurality of locations during one or more time periods of interest, and the additional sound type information is incorporated into the library of sound type information, thereby providing updated sound library information.

8. The method of claim 7, wherein the additional sound type information is generated by human review of the plurality of locational audio streams to generate human validated sound type information.

9. The method of claim 8, further comprising:

a. selecting, by the user or the computer, at least some of the additional sound type information from the updated library of sound type information and incorporating the selected additional sound type information into the collection of sound type information operational on the one or more devices for processing.

10. The method of claim 1, wherein a plurality of notifications associated with a presence or absence of a sound type of interest in the locational audio stream is generated, and the plurality of notifications are presented to a user in a dashboard format.

11. The method of claim 1, wherein when the presence or absence of one or more of the one or more sound types of interest is identified in the audio stream, a real time notification is provided to the user via communication to a mobile device.

12. A method for generating a bulk sound type information library, the method comprising:

a. identifying, by either or both of a user or a computer, one or more sound types of interest for determining presence or absence of the one or more sound types of interest at a location during a time period;

b. acquiring, by one or more sound acquisition devices, one or more audio streams each, independently, incorporating the one or more sound types of interest;

c. processing, by the computer, each of the one or more sound types of interest in the one or more audio streams, thereby generating sound type information and, optionally, notifications to the user or the computer;

d. reviewing, by a human, at least some of the sound type information and, in response to the human review, generate a confidence level for the sound type information generated from the computer processing;

e. selecting, by the user or the computer, a selected confidence level for inclusion of the sound type information in a sound type library; and f. incorporating, by the computer, the sound type information having a confidence level that is greater than the selected confidence level into the sound type library.

13. The method of claim 12, wherein the sound type library is categorized by sound type classes, wherein the sound type classes are associated with one or more of:

a. a sound associated with a human health condition;

b. a sound associated with a human, animal, object, or machine safety condition; and c. a business compliance condition.

14. The method of claim 12, wherein the sound type library is updated with sound type information generated from analysis of a second audio stream generated at a second location of interest, wherein information derived from the second audio stream analysis is incorporated into a bulk sound type information library, thereby providing bulk sound type library information updated with locational sound type information.

15. The method of claim 14, wherein the sound type information derived from the second audio stream is at least partially validated by a human prior to incorporation of the locational sound type information into the bulk sound type information library.

16. The method of claim 12, wherein the sound type library is configured with information derived from one or both of:

a. one or more video streams generated from an image device proximate to one or more locations; or b. one or more environmental sensors proximate one or more of the locations.

17. The method of claim 12, wherein a sound type selection from the sound type library is derived from a bulk sound type information library for operation on a device having audio stream processing capability, wherein the device is configured to acquire an audio stream proximate to the location, and wherein at least some of the audio stream processing is conducted while the device is at the location.

18. A bulk sound type information library produced by the method of claim 12, the bulk sound type information library comprising the sound type information having a confidence level that is greater than the selected confidence level and locational sound type information.

* * * * *